US006655296B2

(12) United States Patent
Theurer

(10) Patent No.: US 6,655,296 B2
(45) Date of Patent: Dec. 2, 2003

(54) METHOD OF RENEWING DAMAGED TIES OF A TRACK

(75) Inventor: Josef Theurer, Vienna (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/114,595

(22) Filed: Apr. 2, 2002

(65) Prior Publication Data

US 2002/0148378 A1 Oct. 17, 2002

Related U.S. Application Data

(60) Provisional application No. 60/283,708, filed on Apr. 13, 2001.

(30) Foreign Application Priority Data

Apr. 11, 2001 (AT) ..... 283/2001 U

(51) Int. Cl.[7] ..... E01B 27/00

(52) U.S. Cl. ..... 104/2; 104/9; 29/402.08; 238/310

(58) Field of Search ..... 104/9, 2, 5, 6, 104/16, 17.1, 17.2; 29/402.08, 402.01, 402.07, 402.09, 402.11; 238/310, 315, 264

(56) References Cited

U.S. PATENT DOCUMENTS

| | | | | | |
|---|---|---|---|---|---|
| 4,484,706 | A | * | 11/1984 | Duchemin | 238/349 |
| 4,778,106 | A | * | 10/1988 | Diener et al. | 238/349 |
| 4,801,084 | A | * | 1/1989 | Rex | 238/351 |
| 4,819,870 | A | * | 4/1989 | Clark et al. | 238/351 |
| 4,832,261 | A | * | 5/1989 | Fee | 238/331 |
| 5,048,424 | A | | 9/1991 | Madison et al. | |
| 5,617,795 | A | | 4/1997 | Glomski et al. | |
| 6,158,353 | A | * | 12/2000 | Theurer | 104/9 |

* cited by examiner

*Primary Examiner*—S. Joseph Morano
*Assistant Examiner*—Frantz F. Jules
(74) *Attorney, Agent, or Firm*—Henry M. Feiereisen

(57) ABSTRACT

Prior to renewing a damaged tie of a track, a fastening element (35) is inserted into an anchoring hole (49) in both portions of the base plate (39), disposed respectively adjacent to the rail base (52), and has a contact nose (51) for abutment against the rail base (52). Subsequently, the fastening element (35) is welded to the base plate (39) so that the base plate remain in its correct disposition with respect to the rail (23) during the tie renewal.

16 Claims, 3 Drawing Sheets

Fig.1
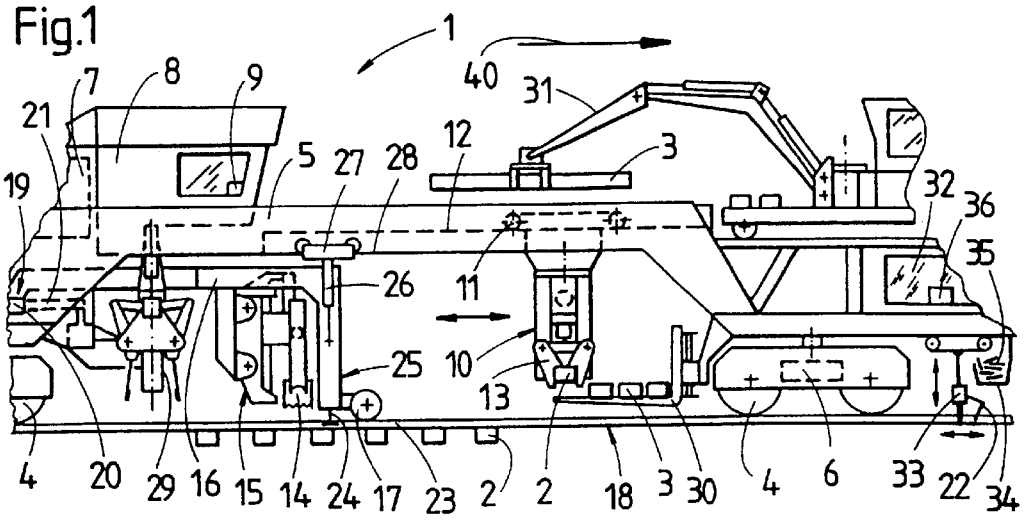
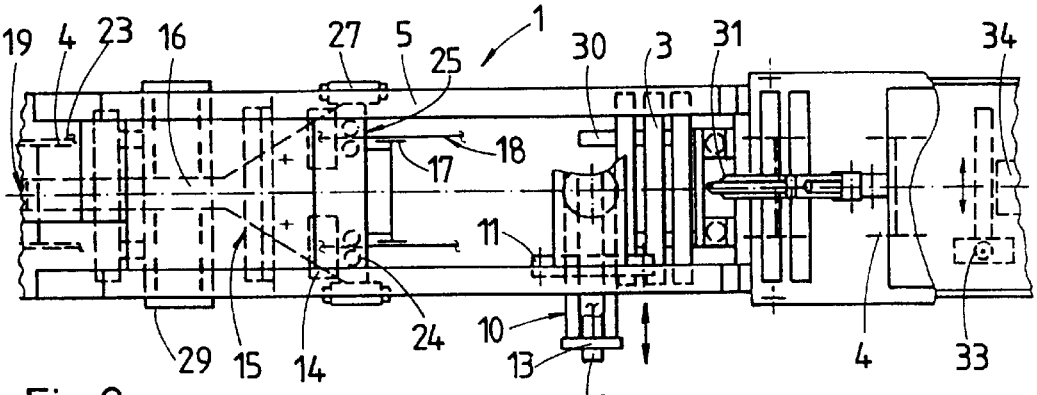
Fig.2

METHOD OF RENEWING DAMAGED TIES OF A TRACK

CROSS-REFERENCES TO RELATED APPLICATIONS

This application claims the benefit of prior filed provisional application, Appl. No. 60/283,708, filed Apr. 13, 2001, pursuant to 35 U.S.C. 119(e), the subject matter of which is incorporated herein by reference.

This application claims the priority of Austrian utility model, Ser. No. GM 283/2001, filed Apr. 11, 2001, pursuant to 35 U.S.C. 119(a)–(d), the subject matter of which is incorporated herein by reference.

BACKGROUND OF THE INVENTION

The present invention relates, in general, to a method for renewal of damaged ties of a track, wherein base plates, having anchoring holes for passage of fastening elements, are positioned between rail base of a rail and tie and secured from the removal of the damaged tie to the introduction of a new tie for providing a connection upon the rail base.

U.S. Pat. No. 5,617,795 describes a tong-shaped apparatus which is provided for gripping base plates and pressed against the rail base of a rail during a replacement of ties. A similar apparatus is described in U.S. Pat. No. 5,048,424 wherein the base plates are secured temporarily by magnets arranged on a vehicle traveling via flanged rollers along the track.

Furthermore, U.S. Pat. No. 6,158,353 discloses the connection of the base plates to the rail base through provisional welding of rail spikes.

It would therefore be desirable and advantageous to provide an improved method of renewing old ties to obviate prior art shortcomings to carry out in a simple manner.

SUMMARY OF THE INVENTION

According to one aspect of the present invention, a method includes the steps of inserting, before removal of the damaged tie, into an anchoring hole in both portions of the base plate, disposed respectively adjacent to the rail base, a fastening element which has a contact nose for abutment against the rail base and is connected to the base plate.

As a consequence, a connection of the base plate with the rail base can be made in a very simple manner, whereby, in an especially advantageous manner, there is no need to remove the connection after placement of the new tie. This is possible because each longitudinal rail side has a total of four anchoring holes of which one is not utilized for the connection of the base plate with the tie.

Suitably, the fastening element is permanently connected to the base plate by welding, e.g., spot welding. After the damaged old tie is replaced by a new tie, rail spikes can be driven into free anchoring holes of the base plate to finalize a connection of the new tie to the rail.

According to another feature of the present invention, the fastening element has the configuration of a spike without head and has one end formed with the contact nose. Suitably, the fastening element has a length sized to prevent a lower end of the fastening element to project beyond a rail-distal bottom plane of the base plate, when inserted in the anchoring hole.

According to another feature of the present invention, an anchor is placed into the anchoring hole for so cooperating with the fastening element as to effect a forced engagement of the fastening element with the base plate. Suitably, the fastening element and the anchor have complementing tapered lower portions, wherein the lower portion of the fastening element has a diameter which is slightly greater than a diameter of the lower portion of the anchor.

According to another aspect of the present invention, a method according to the present invention includes the steps of placing a magnet at each side of a base plate, positioned between the damaged tie and a rail base of a rail, upon a portion adjacent the rail base, for provisional connection of the base plate with the rail base; removing the damaged tie while the magnets remain in place on the base plate; and inserting a new tie underneath the base plate.

The use of a magnet for connection of the base plate with the rail base results in a rapid connection, without requiring to carry out a precise centering step for inserting the magnetic fastening elements in an anchoring hole of the base plate.

According to another feature of the present invention, the magnet may include two spaced-apart magnet members interconnected by a handle to facilitate placement of the magnet members. Suitably, one magnet member is placed between neighboring anchoring holes, and the other magnet member is placed upon the rail base. Once the new tie is secured to the base plate, the magnet can be removed again.

According to another feature of the present invention, the magnet may be connected with a contact nose for abutment against the rail base.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is a partial side elevational view a machine for renewal of ties of a track in accordance with the present invention;

FIG. 2 is a plan view of the tie renewal machine of FIG. 1;

DETAILED DESCRIPTION OF PREFERRED EMBODIMENTS

Figure 3:
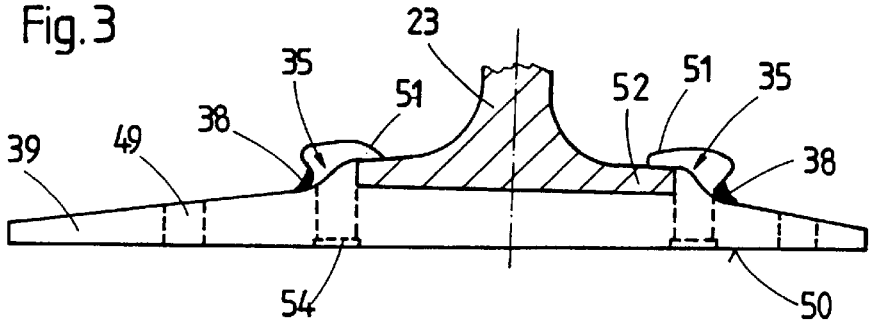
FIG. 3 is a cross section through a rail connected with a base plate utilizing a first variation of a fastening element.

Throughout all the Figures, same or corresponding elements are generally indicated by same reference numerals.

Turning now to the drawing, and in particular to FIGS. 1 and 2, there is shown a track maintenance machine 1 for removing single damaged ties 2 and placement of new ties 3. The machine 1 includes a machine frame 5 supported at its ends by two undercarriages 4. Provided for the forward travel of the machine 1 is a motive drive 6 which, like all the remaining drives of the machine 1, can be activated by a central power unit 7. For the purpose of a better view of the work units, a central control device 9 is arranged in an operator's cab 8 immediately above the work units.

Disposed between the two undercarriages 4 is a tie exchange apparatus 10 which is vertically and transversely displaceable by drives and shiftable in longitudinal direction of the machine by a drive 11 along a longitudinal guide 12 connected to the machine frame 5. Two grippers 13, movable towards one another in the longitudinal direction, are connected to the tie exchange apparatus 10 for picking up old ties 2 in the tie end area. Provided as a further work unit is a ballast clearing device 15 which includes vertically and transversely adjustable clearing members 14 and is supported by a tool frame 16 which can travel on the track 18 via an undercarriage 18 in the region of the tie exchange apparatus 10.

In the end region opposite the undercarriage 17, the tool frame 16 is hingedly supported on the machine frame 5 in the area of a point of articulation 19 and connected to a longitudinal displacement drive 20. The undercarriage 17, mounted to the tool frame 16, and the immediately adjacent ballast clearing device 15 are arranged between the tie exchange device 10 and the point of articulation 19 which is supported by longitudinal guides 21, connected to the machine frame 5, for displacement in the longitudinal direction. Linked to the tool frame 16 in the area of the clearing member 14 is a track lifting device 25 which has a lifting member 24 to rest laterally against a rail 23 of the track 18. Furthermore, a lifting drive 26 is linked to each longitudinal side of the tool frame 16 and has an upper end for connection to a carriage 27 which is supported by a guide 28 of the machine frame for travel in longitudinal direction. Located underneath the operators' cab 8 in the region of each rail 23 is a vertically adjustable tamping unit 29.

A tie deposit unit 30 is provided for commonly depositing old ties 2 as well as new ties 3 and is disposed centrally with respect to a direction transversely to the machine. The machine frame 5 has an opening in the region of the tie deposit unit 30 for passage of a tie gripper 31.

Located at the forward end of the machine 1, as viewed with regard to the operating direction indicated by arrow 40, underneath an operators' cab 32 is a welding robot 33 which is vertically, longitudinally and transversely adjustable by drives and suitable for spot welding. A vertically adjustable magnetic gripper 22 is associated with the welding robot 33. A receptacle 34 contains fastening elements 35.

During tie renewal operation, two fastening elements 35 are taken by an operator located in the operator's cab 32 and inserted at each longitudinal rail side in a free anchoring hole 49 of a base or tie plate 39 (see FIG. 3), wherein a contact nose 51 of the fastening element 35 rests against an adjacent edge of the rail base 52 of the rail 23. Next, the welding robot 33 carries out a spot weld 38 for welding the fastening element 35 to the base plate 39. Subsequently, a spike extractor, not shown in more detail, pulls out the rail spikes from the tie 2 to be replaced.

Subsequently, the old tie 2 is pulled laterally from the track 18 with the aid of the tie exchange device 10 while the rails 23 are slightly raised by the track lifting device 25. The pertaining base plates 39 remain hereby in their original position on the rails 23 as a consequence of the fastening elements 35 —as shown in FIG. 3. Subsequently, a new tie 3 is pushed underneath the cleared base plates 39, again with the aid of the tie exchange device 10. After the new tie 3 inserted in the track 18 has been tamped, rail spikes are driven into the new tie 3 through the free anchoring holes 49 of the base plate 39 in order to establish a final rail/tie connection.

Figure 4:
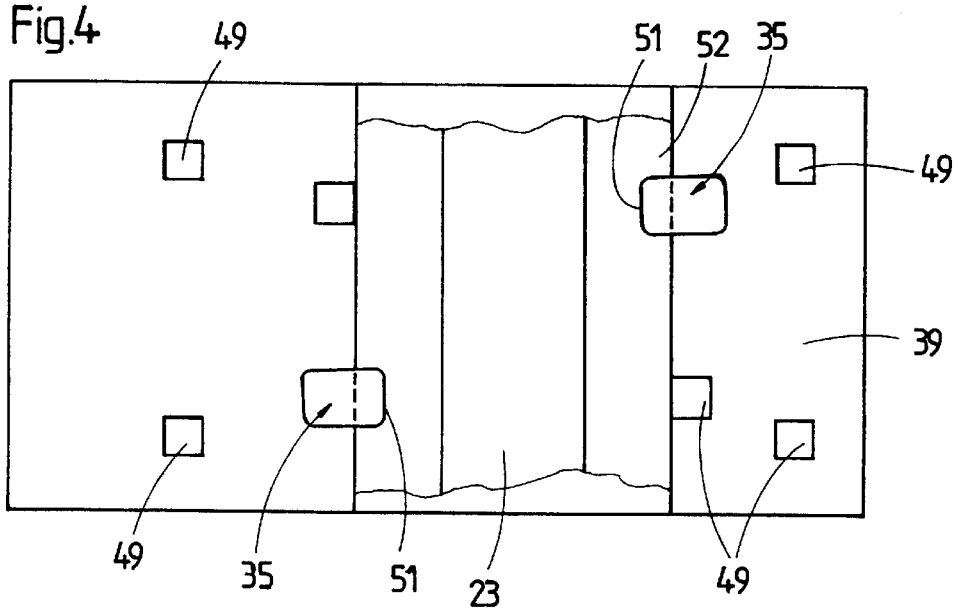
FIG. 4 is a plan view of the base plate.

As shown in FIGS. 3 and 4, only one anchoring hole 49 is used in each longitudinal rail side for insertion of a spike-like fastening element 35 with a contact nose 51 resting against the rail base 52. The fastening element 35 may be suitably made by separating the head-adjacent portion of an old, unusable rail spike. The length of the fastening element 35 is so sized that its lower end 54 does not project beyond a lower plane 50 of the base plate 39.

Figure 5:
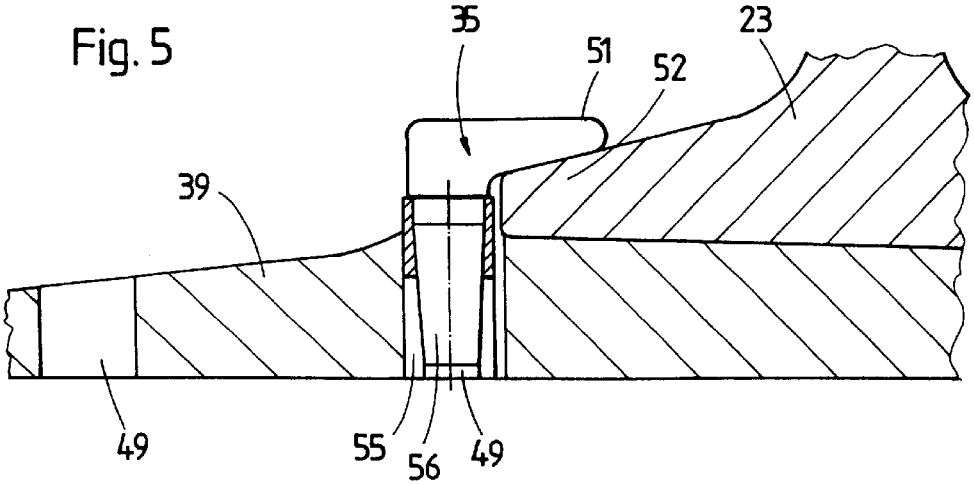
FIG. 5 is a fragmentary sectional view of a second variation of a fastening element.

According to a variation of a fastening element 35, shown in FIG. 5, an anchor 55 is placed together with the fastening element 35 into the anchoring hole 49 of the base plate 39. The anchor 55 as well as the lower portion 56 of the fastening element 35 taper in downward direction. As the lower portion 56 has a diameter which is slightly greater than the diameter of the anchor 55, the insertion of the fastening element 35 automatically results in a forced engagement with the base plate 39.

Figure 6:
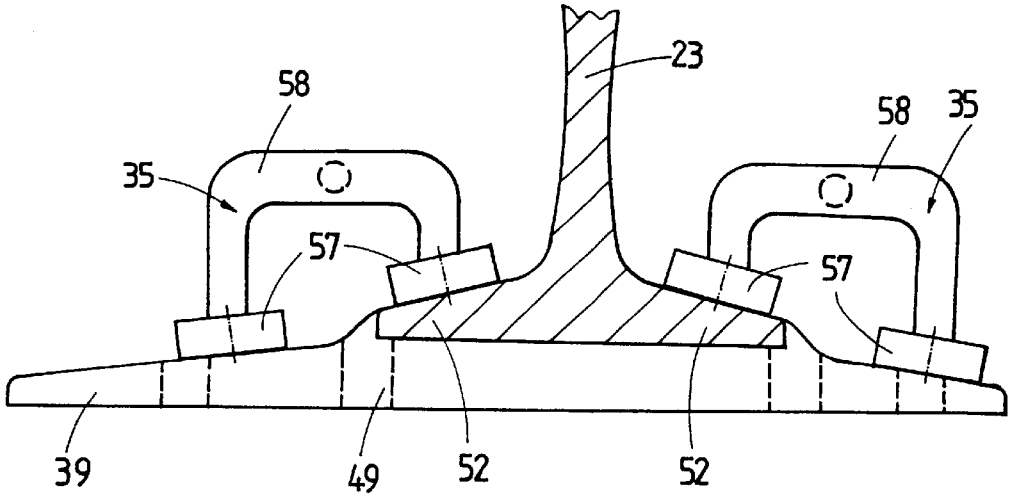
FIG. 6 is a fragmentary sectional view of a third variation of a fastening element.

A fastening element 35, shown in FIG. 6, includes two magnets 57 which are spaced from one another in a direction transversely to the track and interconnected by a handle 58. In order to implement a temporary connection between base plate 39 and the rail 23, the operator so places the fastening element 35 that the one magnet 57 rests on the base plate 39 between the anchoring holes 49 and the received rail spikes 52, respectively, whereas the second magnet 57 is disposed on the rail base 52. After final connection of the base plate 39 and the new tie, the fastening elements 35 are removed again.

Figure 7:
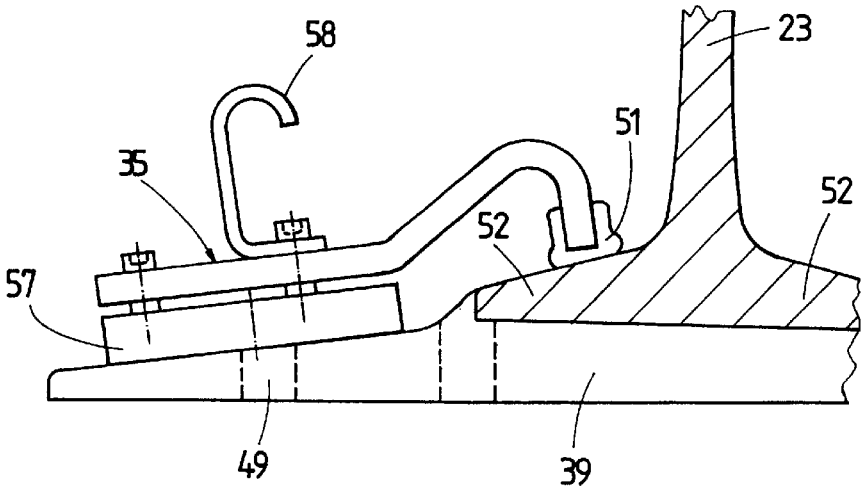
FIG. 7 is a fragmentary sectional view of a fourth variation of a fastening element.

FIG. 7 shows a further variation of a fastening element 35 with a magnet 57 disposed on the base plate 39 and connected with a contact nose 51 for abutment against the rail base 52. A handle 58 facilitates the correct positioning of the fastening element 35 as well as the removal thereof.

While the invention has been illustrated and described as embodied in a method of renewing damaged ties of a track, it is not intended to be limited to the details shown since various modifications and structural changes may be made without departing in any way from the spirit of the present invention. the embodiments were chosen and described in order to best explain the principles of the invention and practical application to thereby enable a person skilled in the art to best utilize the invention and various embodiments with various modifications as are suited to the particular use contemplated.

What is claimed is:

1. A method of renewing a damaged tie of a track, comprising the steps of:

inserting a fastening element into an anchoring hole at each side of a base plate, positioned between the damaged tie and a rail base of a rail, in a portion adjacent the rail base, such that a contact nose of the fastening element rests against an adjacent edge of the rail base;

connecting the fastening element to the base plate;

removing the damaged tie while the fastening element remains in place on the base plate;

inserting a new tie underneath the base plate; and driving rail spikes in free anchoring holes of the base plate to finalize a connection of the new tie to the rail.

2. The method of claim 1, wherein the connecting step includes welding the fastening element to the base plate.

3. The method of claim 2, wherein the fastening element is connected to the base plate by spot welding.

4. The method of claim 1, wherein the removing step includes extracting rail spikes from the damaged tie before the damaged tie is removed.

5. The method of claim 1, wherein the fastening element has a length sized to prevent a lower end of the fastening element to project beyond a rail-distal bottom plane of the base plate, when inserted in the anchoring hole.

6. The A method of renewing a damaged tie of a track, comprising the steps of:

inserting a fastening element into an anchoring hole at each side of a base plate, positioned between the damaged tie and a rail base of a rail, in a portion adjacent the rail base, such that a contact nose of the fastening element rests against an adjacent edge of the rail base;

connecting the fastening element to the base plate;

removing the damaged tie while the fastening element remains in place on the base plate; and inserting a new tie underneath the base plate, wherein the fastening element has the configuration of a spike without head and has one end formed with the contact nose.

7. The method of claim 6, wherein the connecting step includes welding the fastening element to the base plate.

8. The method of claim 7, wherein the fastening element is connected to the base plate by spot welding.

9. The method of claim 6, wherein the removing step includes extracting rail spikes from the damaged tie before the damaged tie is removed.

10. The method of claim 6, wherein the fastening element has a length sized to prevent a lower end of the fastening element to project beyond a rail-distal bottom plane of the base plate, when inserted in the anchoring hole.

11. A method of renewing a damaged tie of a track comprising the steps of:

inserting a fastening element into an anchoring hole at each side of a base plate, positioned between the damaged tie and a rail base of a rail, in a portion adjacent the rail base, such that a contact nose of the fastening element rests against an adjacent edge of the rail base;

connecting the fastening element to the base plate;

removing the damaged tie while the fastening element remains in place on the base plate; and inserting a new tie underneath the base plate;

placing an anchor into the anchoring hole for so cooperating with the fastening element as to effect a forced engagement of the fastening element with the base plate.

12. The method of claim 8, wherein the fastening element and the anchor have complementing tapered lower portions, wherein the lower portion of the fastening element has a diameter which is slightly greater than a diameter of the lower portion of the anchor.

13. The method of claim 11, wherein the connecting step includes welding the fastening element to the base plate.

14. The method of claim 13, wherein the fastening element is connected to the base plate by spot welding.

15. The method of claim 11, wherein the removing step includes extracting rail spikes from the damaged tie before the damaged tie is removed.

16. The method of claim 11, wherein the fastening element has a length sized to prevent a lower end of the fastening element to project beyond a rail-distal bottom plane of the base plate, when inserted in the anchoring hole.

* * * * *